US007423937B2

(12) United States Patent
Bolli et al.

(10) Patent No.: US 7,423,937 B2
(45) Date of Patent: Sep. 9, 2008

(54) TIME CONVERTER

(75) Inventors: Jean-Luc Bolli, Geneva (CH); Jean-Francois Goumaz, Geneva (CH)

(73) Assignee: Agilent Technologies, Inc., Santa Clara, CA (US)

( * ) Notice: Subject to any disclaimer, the term of this patent is extended or adjusted under 35 U.S.C. 154(b) by 218 days.

(21) Appl. No.: 10/955,282

(22) Filed: Sep. 30, 2004

(65) Prior Publication Data

US 2005/0122846 A1 Jun. 9, 2005

(30) Foreign Application Priority Data

Oct. 1, 2003 (EP) ..... 03103642

(51) Int. Cl.
*G04F 8/00* (2006.01)
*G04F 10/00* (2006.01)
*G04F 1/00* (2006.01)

(52) U.S. Cl. ..... 368/118; 368/89; 702/176

(58) Field of Classification Search ..... 368/118, 368/59, 90, 93, 94, 95, 98, 99, 100, 113, 368/119, 327; 702/176, 177
See application file for complete search history.

(56) References Cited

U.S. PATENT DOCUMENTS

| | | | | | |
|---|---|---|---|---|---|
| 3,618,089 | A | * | 11/1971 | Moran, Jr. | 368/107 |
| 3,889,189 | A | | 6/1975 | Lode | |
| 4,090,141 | A | * | 5/1978 | Leblanc | 327/3 |
| 4,908,784 | A | | 3/1990 | Box et al. | |
| 4,982,350 | A | * | 1/1991 | Perna et al. | 702/89 |
| 5,027,298 | A | | 6/1991 | Khazam | |
| 5,150,337 | A | | 9/1992 | Inbar | |
| 5,200,933 | A | | 4/1993 | Thornton et al. | |
| 5,243,344 | A | * | 9/1993 | Koulopoulos et al. | 341/143 |
| 5,566,139 | A | * | 10/1996 | Abshire | 368/118 |
| 5,903,523 | A | * | 5/1999 | Peck | 368/202 |
| 6,097,674 | A | * | 8/2000 | Swapp | 368/113 |
| 6,137,749 | A | * | 10/2000 | Sumner | 368/113 |

* cited by examiner

*Primary Examiner*—Daniel J. Colilla
*Assistant Examiner*—Leo T Hinze

(57) ABSTRACT

A digital time converter with an embodiment including a coarse measuring circuit and a fine measuring circuit. The fine measuring circuit allows an accurate determination of the temporal position of an event inside a period of the time base, by interpolation or averaging of sinusoids in quadrature, sampled coincidentally with a burst of impulses generated by the converter's triggering circuit.

23 Claims, 8 Drawing Sheets

TIME CONVERTER

REFERENCE DATA

This application claims priority of European patent application 2003EP-3103642 (as yet unpublished) filed on Oct. 1, 2003, the contents whereof are hereby incorporated by reference.

TECHNICAL FIELD OF THE INVENTION

The present invention concerns the field of time converters, and more precisely of time-digital-converters, designated TDC (Time-Digital-Converters).

BACKGROUND OF THE INVENTION

Time digital converters, or TDC, are used whenever one wishes to measure and encode accurately the temporal position of an event, or of a plurality of events, represented by electric pulses, relatively to a reference signal, defining the origin of the temporal scale.

TDCs are used for example in the field of particle physics, to measure the transit time of the elementary particles produced during an interaction, in the different active zones of a segmented particle detector.

TDCs also have applications in many other fields in which an accurate measurement of arrival times of electric pulses is required. In particular, but not exclusively, applications of TDCs comprise temporal photon correlation microscopy, optical tomography, electronic component testing, time-of-flight spectroscopy and reflectometry in the time domain.

A well-known method for encoding time intervals is to count electronically the number of pulses of a clock signal and to copy the value of the counter during the event of interest into a register.

A limitation of this method is that the measurement accuracy is limited by the rate of the clock signal. For a resolution of 10 picoseconds, for example, a 100 gigahertz clock signal is required, so that this level of precision can only be achieved with difficulty by this method.

Another known method is to convert the interval to be measured into a proportionally longer interval, for example with a double-ramp converter, in which a capacitor is loaded and then unloaded with two constant currents of different value.

The time required for the voltage at the terminals of the capacitor to return to zero is proportional to the sought time interval and can be measured with a counter whose rate is relatively low. An inconvenience of this method is the relatively great dead time associated to each measured event, so that this method is only applicable with difficulty to multiple and close pulses, such as for example signals generated by detectors of elementary particles (multi-hit events).

Another inconvenience of the above method is connected to the difficulty of realizing current sources that are constant and independent from the ramp's voltage. Any difference of behavior between the two sources will induce conversion errors.

It is also known to transform a time interval into an analog voltage or load signal of proportional value, thanks to a time amplitude converter (TAC), and to then convert the analog signal into a digital signal by an analog-to-digital converter (ADC). This method has however the disadvantage of a complex and delicate calibration. Another inconvenience of the above method is connected to the difficulty of obtaining a voltage ramp that is exactly linear. The non-linearity of the capacity and/or the non-constancy of the current source are the origin of conversion errors. This method further requires a ramp calibration procedure due to the inevitable initial imprecision of the ramp capacity and current.

It is an aim of the present invention to present a time converter that does not have the inconveniences of the prior art.

It is another aim of the present invention to propose a time converter that associates a high resolution and depth, allowing very accurate measurements of extended temporal intervals.

It is another aim of the present invention to allow a time converter to be made whose resolution is programmable and adaptable to the needs of the application.

It is another aim of the invention to make a time converter that does not require a calibration procedure for it to maintain its accuracy.

BRIEF SUMMARY OF THE INVENTION

These aims are achieved by the device that is the object of the main claim, and notably by a device for measuring the temporal position of an event, comprising: a startable signal generator for generating a periodical signal synchronous with said event and whose phase is correlated to the temporal position of said event, characterized in that said measuring device comprises a first analog-to-digital converter for measuring a plurality of samples of a first reference signal during said event, the values of said samples determining said phase of said periodical signal.

BRIEF DESCRIPTION OF THE DRAWINGS

The invention will be better understood by reading the claims and the detailed description illustrated by the figures in which:

DETAILED DESCRIPTION OF THE INVENTION

Figure 1A:
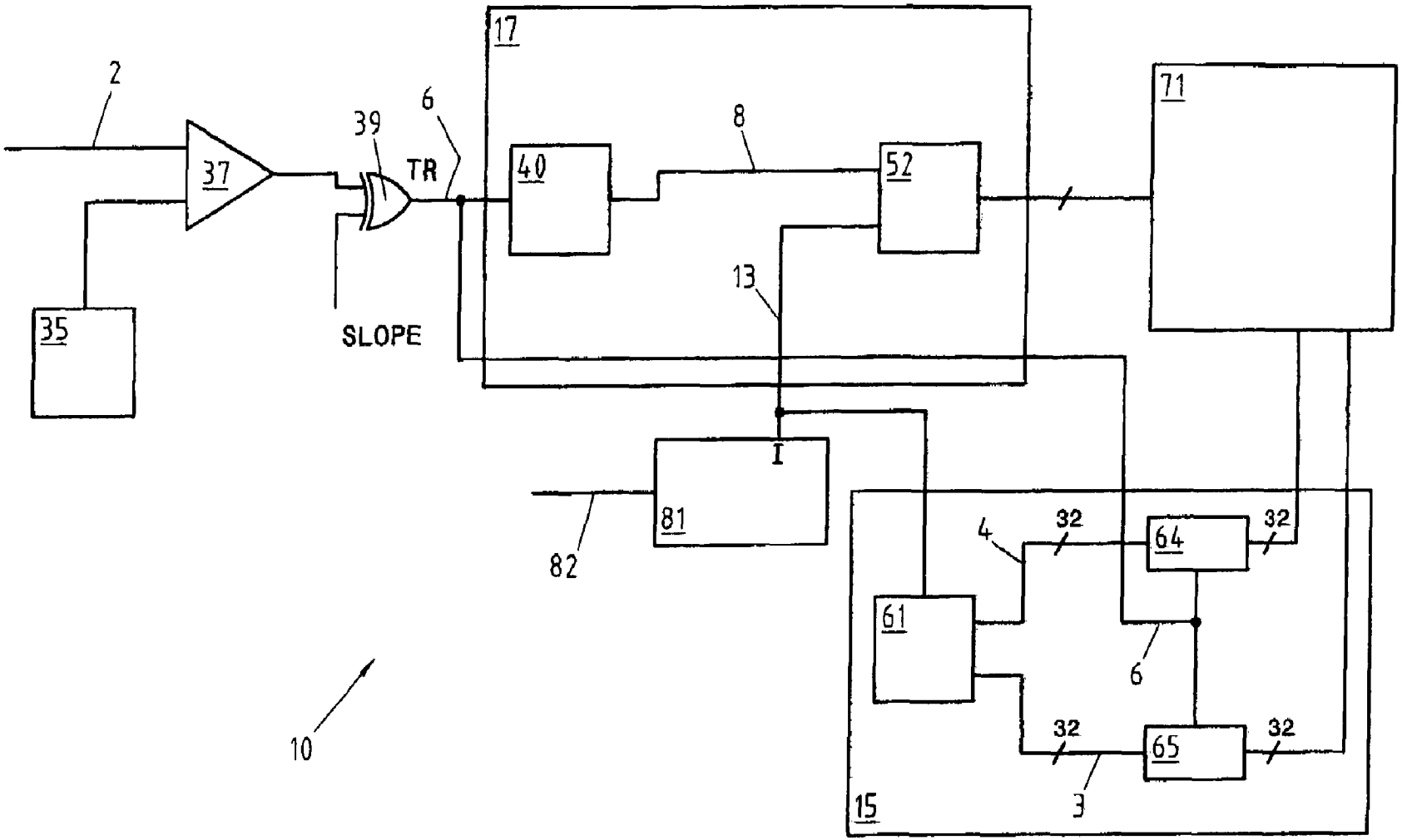
FIG. 1*a* represents a block diagram of a time converter according to one embodiment of the invention.
Figure 1B:
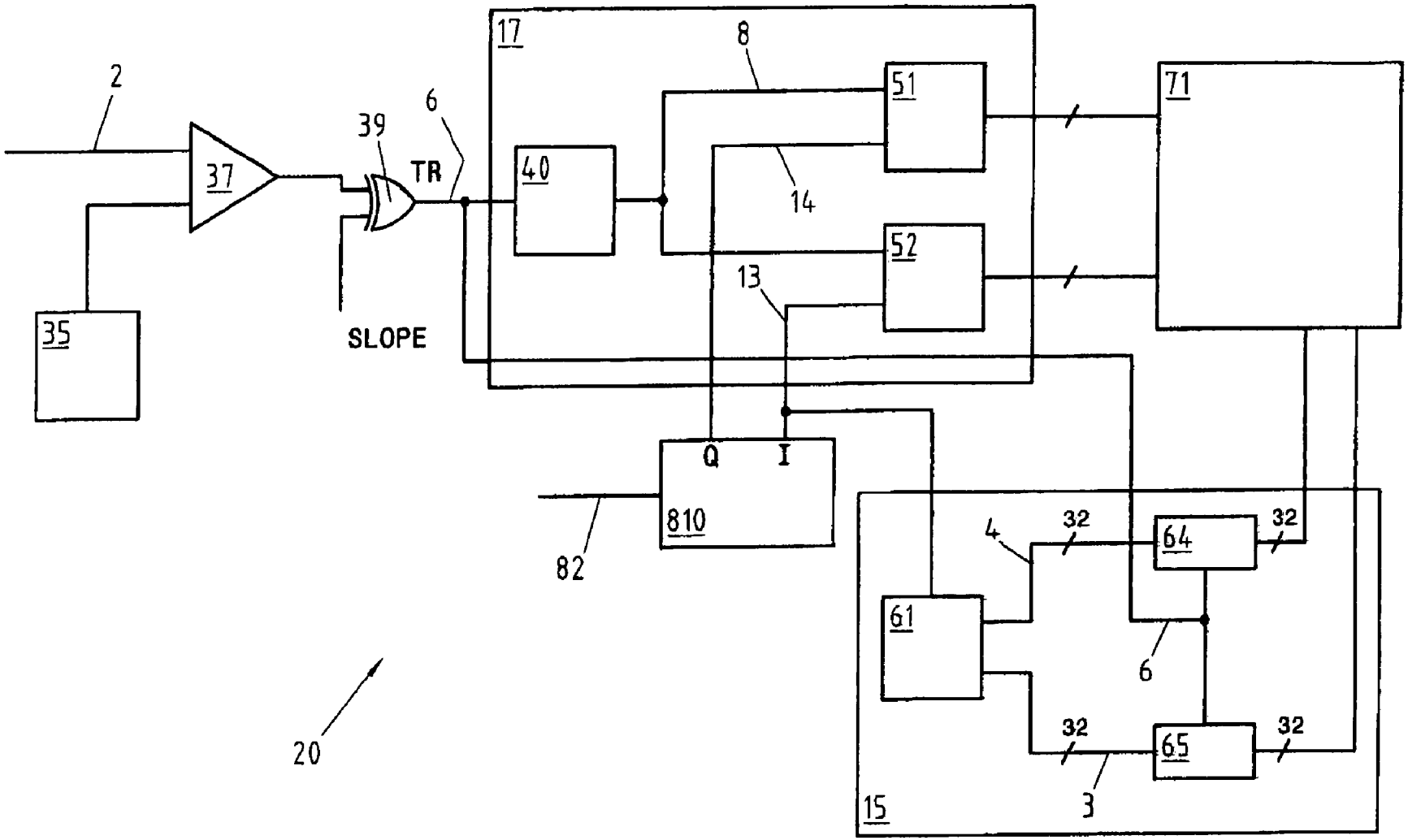
FIG. 1*b* represents a block diagram of a time converter according to a later embodiment of the invention.

The general functioning of a converter 10 according to one aspect of the present invention is now described with reference to the block diagram of FIG. 1 and to the chronogram of FIG. 2.

The input signal 2 is an analog or digital signal comprising voltage or current pulses corresponding generally to events whose temporal position is to be determined accurately. In FIG. 1, the signal 2 is connected to an input of a discriminator 37 to obtain a digital trigger signal 6 (TRIG, TR), whose edge corresponds to the event signalized by the pulse 2.

When required by circumstances, the discriminator could be preceded by a circuit for conditioning the input signal 2, not represented in FIG. 1. The conditioning circuit can for example include an element for protection against surge voltage, a delay line, an amplifier, attenuators, impedance adapters and any other electric or electronic element necessary to adapt the characteristics of the signal 2 to the discriminator 37.

A second input of the discriminator 37 is connected to the converter DAC 35 that supplies a constant voltage level 5 representing a threshold level to be exceeded for an event to be detected by the converter 10. Generally, the threshold level 5 will be placed sufficiently low to detect also small pulses, yet sufficiently far from the noise level to limit false triggering.

The DAC 35 allows the threshold value 5 to be easily adapted to the measurement conditions. In a simplified embodiment of the invention, and whenever this flexibility of use is not required, the DAC 35 can be replaced by a generator of fixed or variable reference voltage.

In another embodiment of the invention, the discriminator 37 is a constant fraction discriminator (CFD) that triggers the trigger pulse when the input level has reached a predetermined fraction of its peak value. This arrangement is particularly useful when the amplitude of the input signals can vary from one event to another.

In the diagram of FIG. 1, the discriminator 37 detects the ascending flank of the input signal 2. There are however situations in which it is necessary to detect the descending flank, for example when processing pulses with a negative polarity. In this case, the logical gate 39, controlled by the input 38, allows a logical trigger signal 6 with the required polarity to be obtained.

In a first embodiment of the invention, described with reference to FIG. 1*a*, the generator 81 produces the sinusoidal signal 13 serving as time base for the converter 10. The sinusoid 13 is generated from an external clock signal 82, as indicated in FIG. 1*a*, or by a local time base generator, not represented. The frequency of the signal 13 is chosen according to the application and to the desired temporal resolution, within the limits imposed by the speed of the components used. In a typical case, a frequency of 100 MHz can be adopted although the present invention obviously also comprises devices with a higher or lower rate, as the case may be.

The digital trigger signal 6 is sent to a coarse measuring system 15, described further below in connection with FIGS. 1*a* and 2*a*. The coarse measuring circuit 15 comprises the real time counter 61 and the two registers 64, 65.

The real time counter 61 counts the periods of the sinusoidal signal 13 and is used to feed the two buses 3 and 4, whose contents change synchronously, being incremented at each cycle of the time base 13, during the entire time during which the converter 10 is active. The bus 4 is offset by one half-period relatively to the bus 3 by a logical delay circuit, not represented.

The number of bits of the buses 3 and 4 is chosen as a function of the maximal temporal distance between two events that one wishes to record. Assuming that the time base runs at 100 MHz and that the buses 3 and 4 comprise 32 bits each, the maximal duration will be of 43 seconds. If a more limited duration is sufficient, one can limit the depth of the buses 3 and 4 and of the counter 61, for example to 24 bits for a depth of 167 ms.

The registers 64 and 65 sample the contents of the buses 3 and 4 at the instant of each event signalized by the ascending flank of the trigger signal 6. The content of the registers is then copied into a storage zone provided to this effect in the logical unit 71.

In a preferred embodiment of the invention, the coarse measuring system 15, comprising the real time counter 61, the two buses 3, 4, the delay unit and the registers 64, 65 are realized within an integrated circuit of the type FPGA (Field Programmable Gate Array). Preferably, the FPGA circuit will also comprise the logical unit 71.

The trigger signal 6 is also sent to a fine measuring device 17, comprising the pulse generator 40 and the ADC 52.

The pulse generator 40 triggers a burst of pulses 8 in correlation with each event marked by a pulse of the trigger signal 6. The signal 8 serves as clock for the ADC 52 that samples the sinusoidal signal 13 in correlation with each pulse of the signal 8. The generated signal 8 is, due to the manner in which the circuit 40 functions, synchronous with the trigger signal 6. The signal 8 contains, by the value of its phase, the information on the arrival instant of the event.

The values sampled by the ADC 52 are stored in the logical unit 71. The fact of taking several samples of the sinusoid 13 allows the phase of the latter at the moment of the trigger signal 6 to be determined with a high resolution, as will be seen later.

Assuming that the sinusoidal signal 13 is represented by the relation:

$$S(t)=A\cdot\sin(\omega_0\cdot t)+D \tag{1}$$

where the quantity $\omega_0$ represents the angular frequency of the signal 13, which is known since it is linked to the internal or external time base, A represents the amplitude of the sinusoid 13 and D represents the voltage, unknown a priori.

At the instant of the trigger TRIG, a burst of N measurements of the signal S(t) is triggered and recorded in 71. One has, for the N samples:

$$S_i=A\cdot\sin(\omega_0\cdot(t_0+i\cdot T_s))+D\ i=0\ldots N-1 \tag{2}$$

where $T_S$ represents the distance between two pulses of a burst. The N relations (2) thus constitute a system of N equations with the unknown:

$t_0$ represents the instant of arrival of the trigger relatively to the zero crossover of S(t);

A represents the amplitude of the sinusoid 13;

$T_S$ represents the period with which the sinusoid 13 is sampled (inverse of the frequency of the burst of pulses 8);

D represents the vertical offset of the sinusoid in the scale of the ADC.

All the unknown values, and in particular to (which is the one of interest), can thus be determined as soon as $N \geqq 4$.

For N>4, the system (2) is over-determined. On can then use best-fit or error minimization techniques to improve the resolution of the fine measurement. The accuracy of the fine measurement thus improves by a factor $\sqrt{N-3}$, for example by N=7 the resolution is improved by a factor 2; for N=19, the resolution is improved by a factor 4 and so on, the initial temporal resolution (N=4) being determined by the frequency $\omega_0$ and the number of bits of the ADC 52.

The amplitude A is chosen so as to occupy at most the scale of the ADC 52, without however exceeding it.

The sampling period $T_S$ is chosen judiciously as a function of the period $T_0$ of the sampled sinusoid. Preferably, a considerably greater rate will be adopted than that of the sinusoid 13, in order to accelerate the conversion time. For example, pulses separated by 1 ns and an ADC 52 with a conversion rate of 1GS/s may be chosen.

Preferably, the three unknown quantities A, $T_S$ and D are determined at each new trigger signal and their value is ignored or used for monitoring purposes only. This measuring method has the advantage of not requiring any calibration, the accuracy of the measurement then resting only on the absolute precision and the stability of the frequency $\omega_0$.

The quantities A, $T_S$ and D are however more or less constant and could be determined once and for all or periodically by a suitable calibration method. It is also possible in the present invention to evaluate separately the quantities A, $T_S$ and D during an automatic calibration or on the initiative of an operator, thus reducing the number of pulses required to achieve the desired resolution and limiting the dead time of the converter 10. In a later embodiment of the invention, the calibration of A, $T_S$ and D could also be performed only when certain predetermined conditions are met, for example once for the first hit of each event, but not for successive hits.

Thanks to the multiple samples, it is possible to increase considerably the temporal resolution of the converter 10. For example, by digitizing 9 samples of the sinusoid 13 at 100 MHz with an ADC at 6 bits, it is possible to achieve a resolution of 25 ps or better.

According to the case and the characteristics of the components used, it is possible that all the pulses 8 are not sampled. If for example the ADC 52 has an internal pipeline architecture, one or several pulses at the beginning and at the end of the burst are necessary only to activate the ADC and to extract the data from the pipeline. In this case, the number of pulses in each burst can be increased in order to always have a sufficient number of samples.

Figure 5:
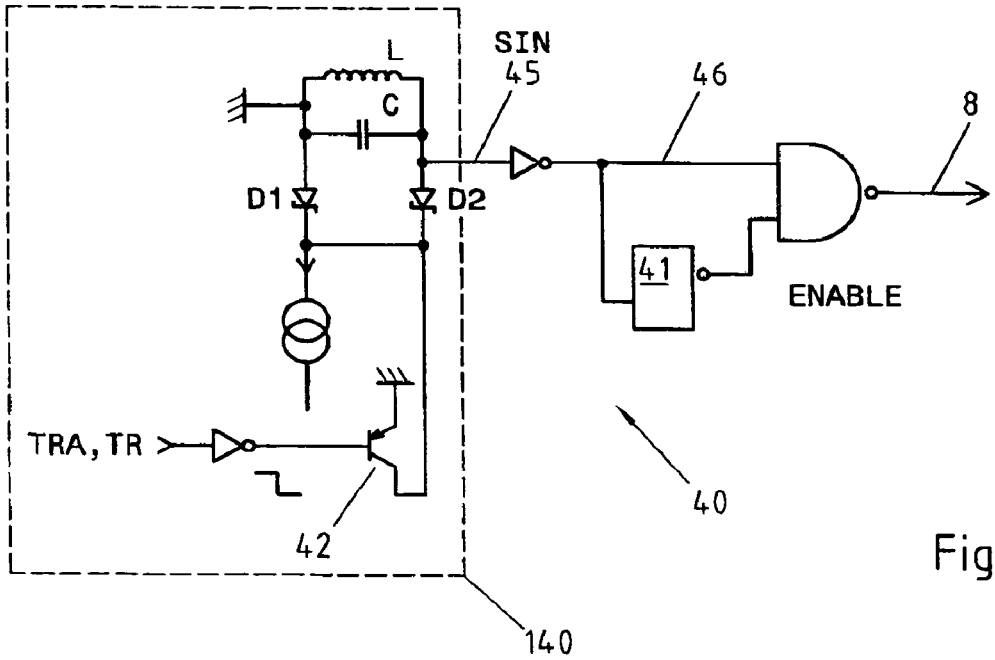
FIGS. 5 and 7 represent two possible embodiments of a pulse generator of the invention.
Figure 6:
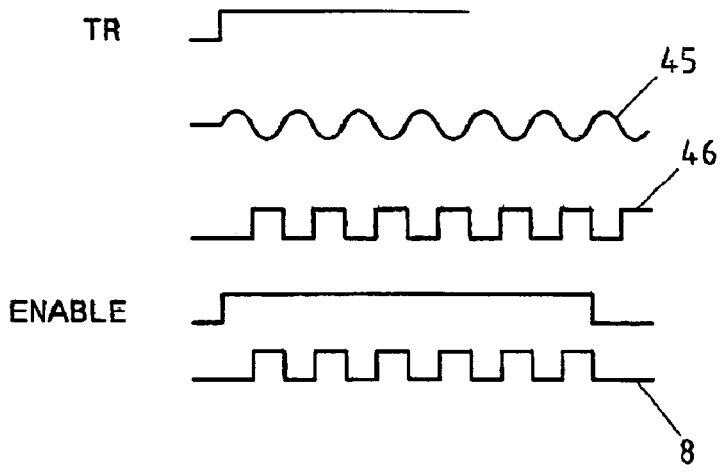
FIG. 6 represents a chronogram illustrating the functioning of the circuit of FIG. 5.

The pulse generator 40 represented in FIG. 5 comprises an oscillator LC that can be started by the transistor 42. Upon receipt of a trigger signal 6, a sinusoid is present at the terminal 45 whose frequency is determined by the values of L and C. The counter 4 counts a predefined number of pulses of the discriminated signal 46 and resets the signal Enable, to cut the burst of pulses to the desired length.

Figure 7:
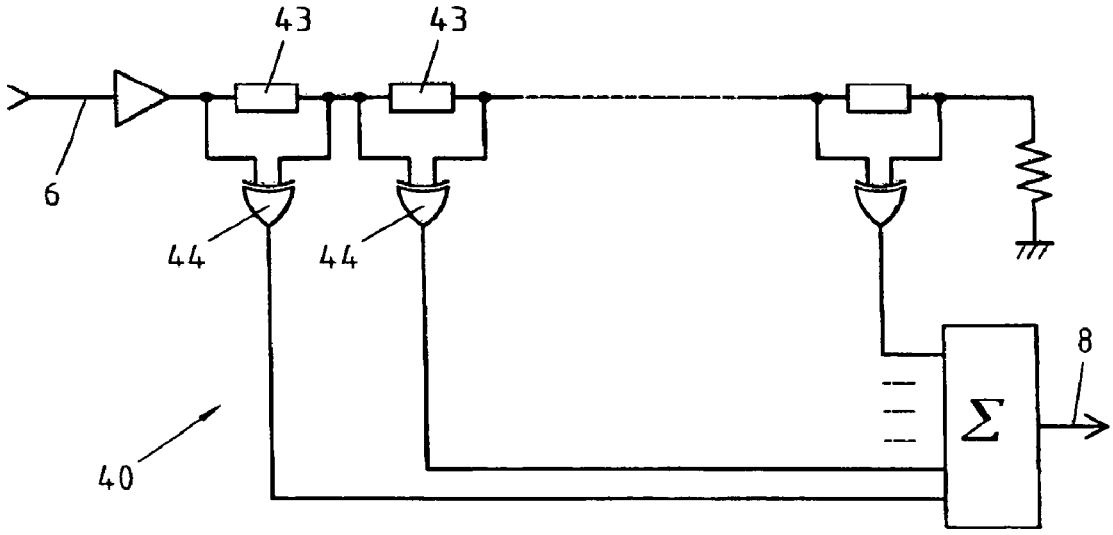

FIG. 7 represents an alternative circuit for the pulse generator 40, comprising delay lines 43. Each cell, composed of a delay line 43 and of a XOR gate 44, produces a temporally offset pulse. The analog sum means Σ recomposes the pulses to give rise to the burst of pulses 8.

During the explanation on how the coarse measuring device functions, it has been seen that the two registers 64 and 65 record two measurements independent from the temporal position of the event relatively to the two time bases 3 and 4 that are isochronous and offset by half a period. This duplication allows ambiguities due to the metastability of the buses 3 and 4 during the transitions 90, visible in FIG. 2, to be avoided.

At the end of a period of measurement, the internal memory of the unit 71 contains the raw data relative to each event, i.e., for each event:

- the value K of the registers 64 and 65 of the coarse measuring device 15;
- the N codes $S_N$ resulting from the sampling of the sinusoid 13 in correlation with the N pulses of the burst of pulses 8 of the fine measuring device 17.

An evaluation and reading routine allows the temporal position of each recorded event to be computed. The routine comprises, for each event having generated a trigger signal 6, the following steps:

- The data of the fine reading device 17 must be translated into relative time $t_0$ over the period of the sinusoid l. This part of the algorithm uses samples $S_i$ recorded in bursts to compute the phases $\phi_i$ and the relative time $t_0$, by inverting the system (2), as explained here above.
- The value of $t_0$ makes it possible to know which of the latches 64 and 65 has recorded the real time $T_R$ correctly, without metastability induced by the transitions 90. Knowledge of and $t_0$ of $\phi_0$ always makes it possible to determine which of the two registers 64 and 65 contains the exact value of the real time, and remains further removed from the transitions 90. In the example of FIG. 2, the transitions of the bus 3 are located in the phase −90° relatively to the sinusoid l, whereas the transitions of the bus Q are located at the phase +90°. Thus, the algorithm will chose, for computing $T_R$, the bus 3 when $0 \leqq \phi_0 \leqq 180°$ and the bus 4 if $180° \leqq \phi_0 \leqq 360°$. The real time is then given by $T_R = 2\pi K/\omega$. The one skilled in the art will easily understand that other arrangements of the offsetting between the signal S(t) and the bus 3, 4 are also possible in the present invention.
- The time of the event is obtained by adding the real time and the relative time: $T_{ev} = T_r + T_0$.

According to the case, the evaluation and reading routine could be stored in the logical unit 71 and executed by a local processor, or executed by a master processor that can access the raw data stored in the unit 71 over a suitable communication bus, such as for example a bus PCI, VME or VXI.

A second embodiment of the present invention is now described with reference to FIG. 1*b*.

In this embodiment, the inventive time converter 20 comprises a generator 810 that produces the two sinusoidal signals 13 and 14 in quadrature that serve as time base for the converter 10. The first sinusoid 13 is also designated by I (In phase) and the second sinusoid 14 by Q (Quadrature). The signals 13 and 14 are generated from an external clock signal 82, as can be seen in FIG. 1, or by a local oscillator, not represented. The frequency of the signals 13 and 14 is chosen as a function of the resolution one wishes to achieve, as in the first embodiment already described.

Figure 3:
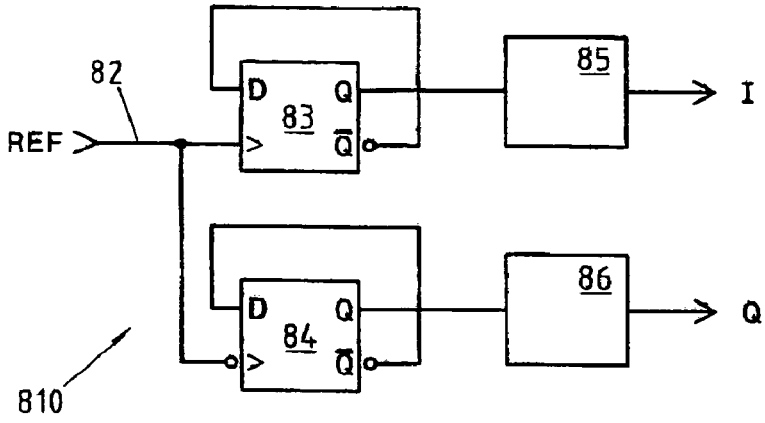
FIGS. 3 and 4 represent two possible embodiments of a generator for the time base of the device according to the invention.

The generator of the signals I and Q 810 is now described with reference to FIGS. 3 and 4. The reference signal 82 originating from outside or from a local oscillator is applied to the inputs of the two flip-flops 83, 84 to generate two square signals offset by 90°, whose frequency is half that of the signal 82. The two identical band-pass and low-pass filters 85 and 86 transform the square signals into sinusoidal signals.

Figure 4:
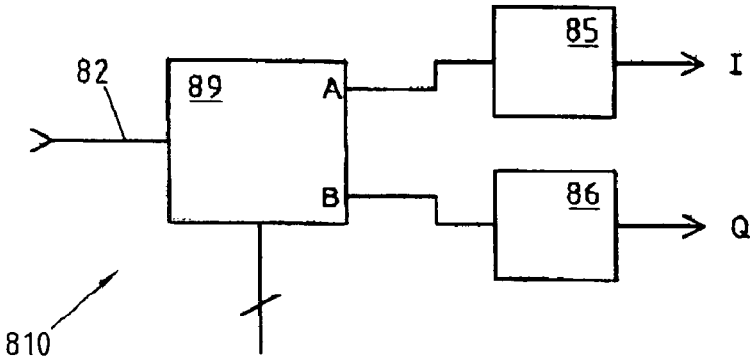

In a variant embodiment of the generator 810, represented in FIG. 4, the flip-flops 83, 84 are replaced by a programmable clock generator 89. The circuit 89 produces at its outputs A and B two square signals having each a determined phase relation with the reference signal 82 programmable by the input bus 120. In the circuit of FIG. 4, the delaying between the signals I and Q can thus be easily calibrated. Preferably, the programmable generator 89 is integrated in the FPGA.

The frequency of the reference signals I and Q can be changed to adapt to the measurement conditions, by suitable means not represented.

Figure 2A:
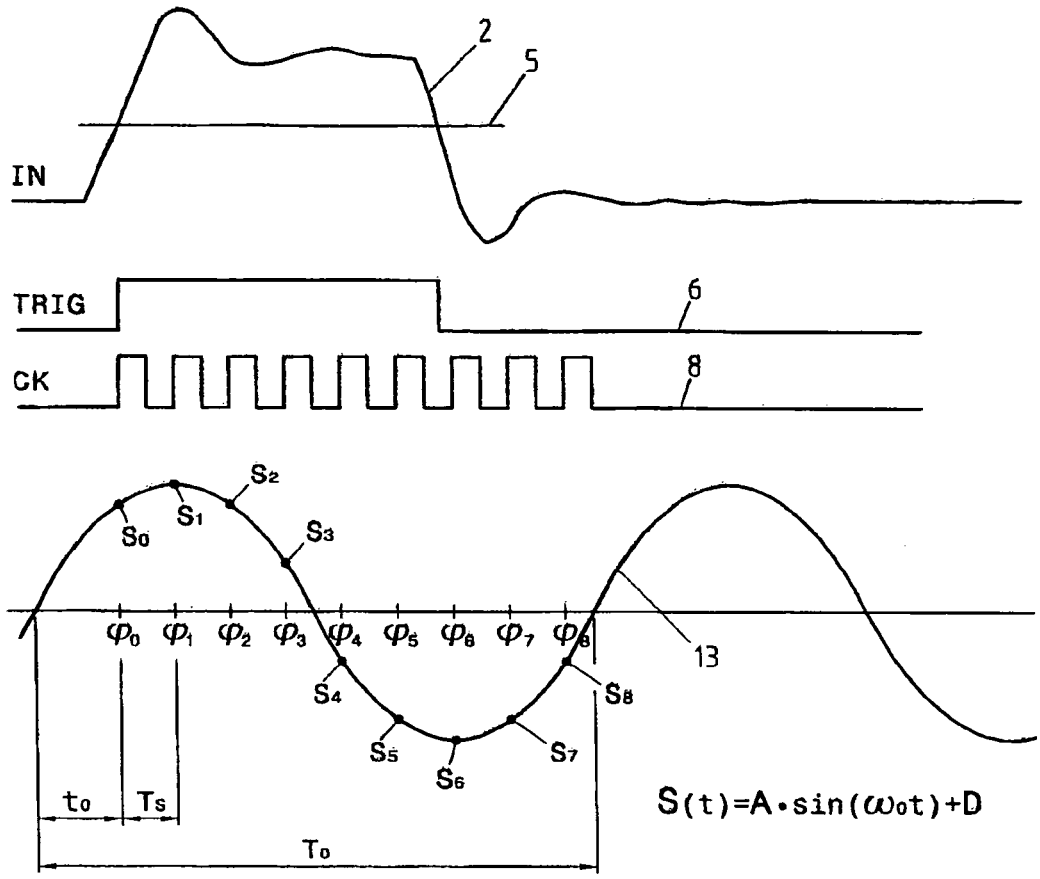
FIGS. 2*a* and 2*b* represent chronograms of different signals of the circuits of FIGS. 1*a* resp. 1*b;*
Figure 2A:
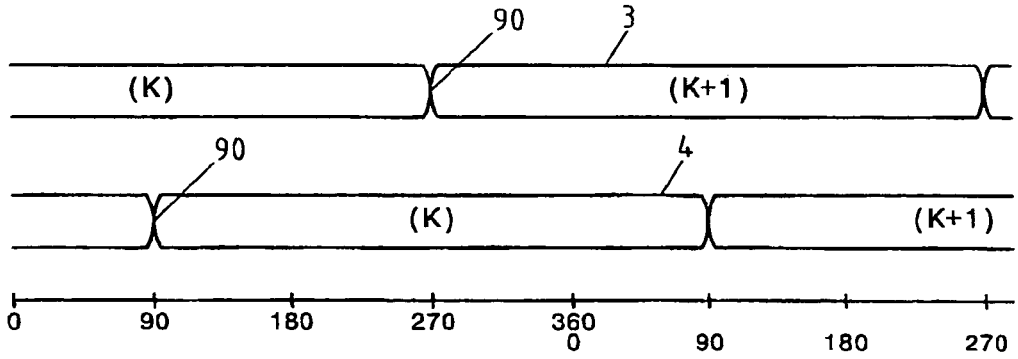

The digital trigger signal 6 is sent to a coarse measuring system 15, identical to that already described in relation to the first embodiment of this invention represented in FIGS. 1*a* and 2*a*.

The trigger signal 6 is also sent to a fine measuring device 17, comprising the pulse generator 40 and the two ADCs 51 and 52.

The pulse generator 40 triggers a burst of pulses 8 in correlation with each event marked by a pulse of the trigger signal 6. The signal 8 serves as clock for the two ADCs 51 and 52 that sample the two sinusoidal signals in quadrature 13 and 14 in correlation with each pulse of the signal 8.

Figure 2B:
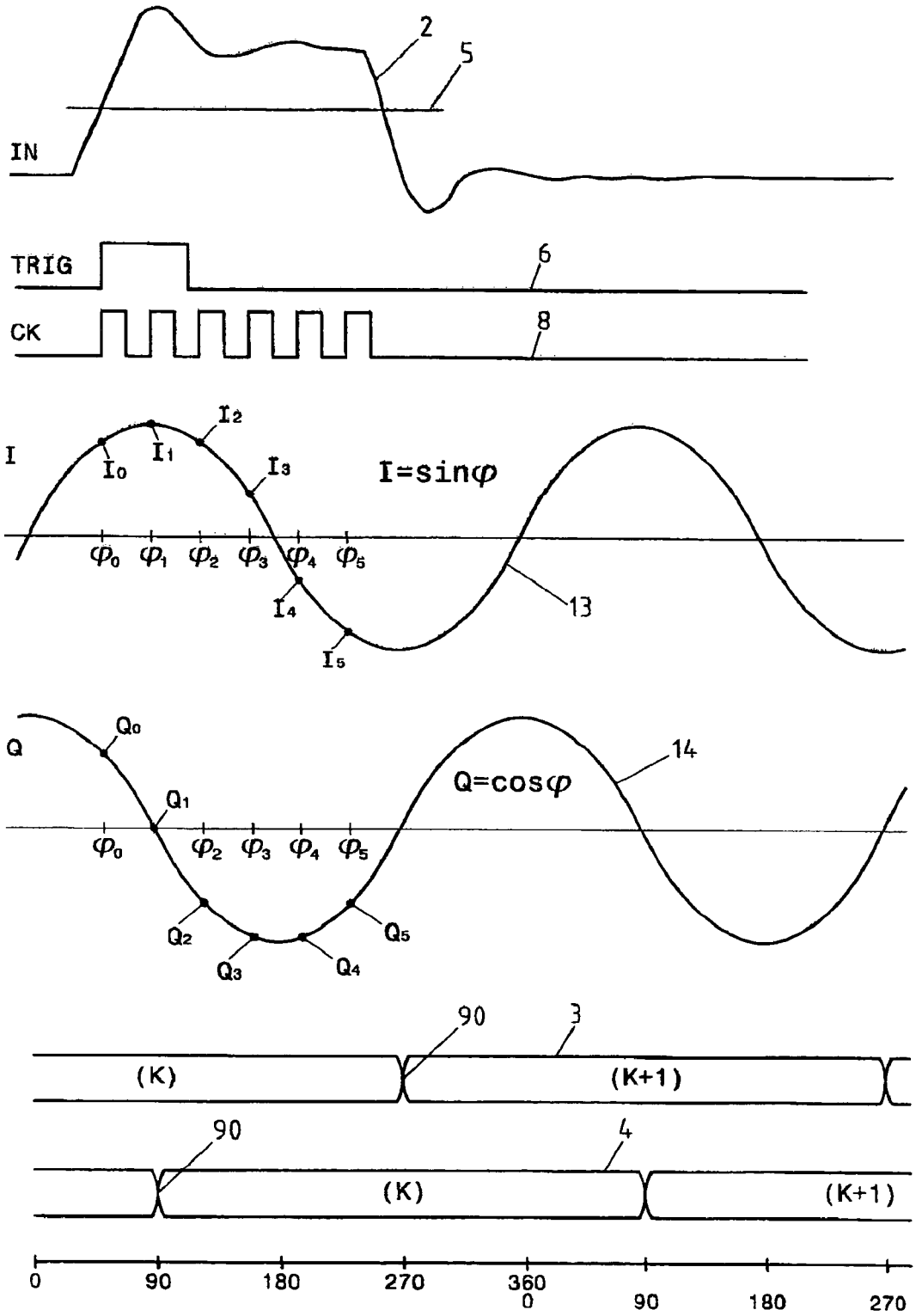

Reverting now to the FIG. 2*b*, the values sampled by the ADCs 51 and 52 are stored in the logical unit 71, and each pair of codes I and Q is used to determine the phase $\phi$ of the sinusoid I during its sampling, according to the trigonometric relation $\phi=\arctan(I/Q)$, thus obtaining a fine measurement of the arrival time of the event.

Although this embodiment of the invention provides for a pair of sinusoids in quadrature as time reference, the invention is not limited by this example. A converter according to the invention could also use two signals offset by an angle different from 90° or of different shapes, for example triangles, instead of the sinusoids 13 and 14.

Since the signal 8 is composed of a burst of pulses regularly spaced in time, each event gives rise to several samples $I_i$ and $Q_i$, and to several values of the phase $\phi_i=\omega_0\times t_i$, where $\omega_0$ represents the angular frequency of the sinusoids I and Q and $t_i$ the departure time of the $i^{th}$ pulse of the burst of pulses 8. The relative arrival time to of the pulse 6 can thus be determined more accurately, in similar manner to that described in the first embodiment here above, or by averaging or interpolating methods, for example by linear regression of the values $\phi_i$.

Thanks to the parallel sampling of two sinusoids, it is possible to store a greater number of values $I_i$ and $Q_i$ in a time, in comparison to the first embodiment. This variant embodiment of the invention thus offers, for an equivalent resolution, a reduced dead time.

A preferred embodiment of the invention of the present invention is now described with reference to FIGS. 8 and 9.

Figure 8:
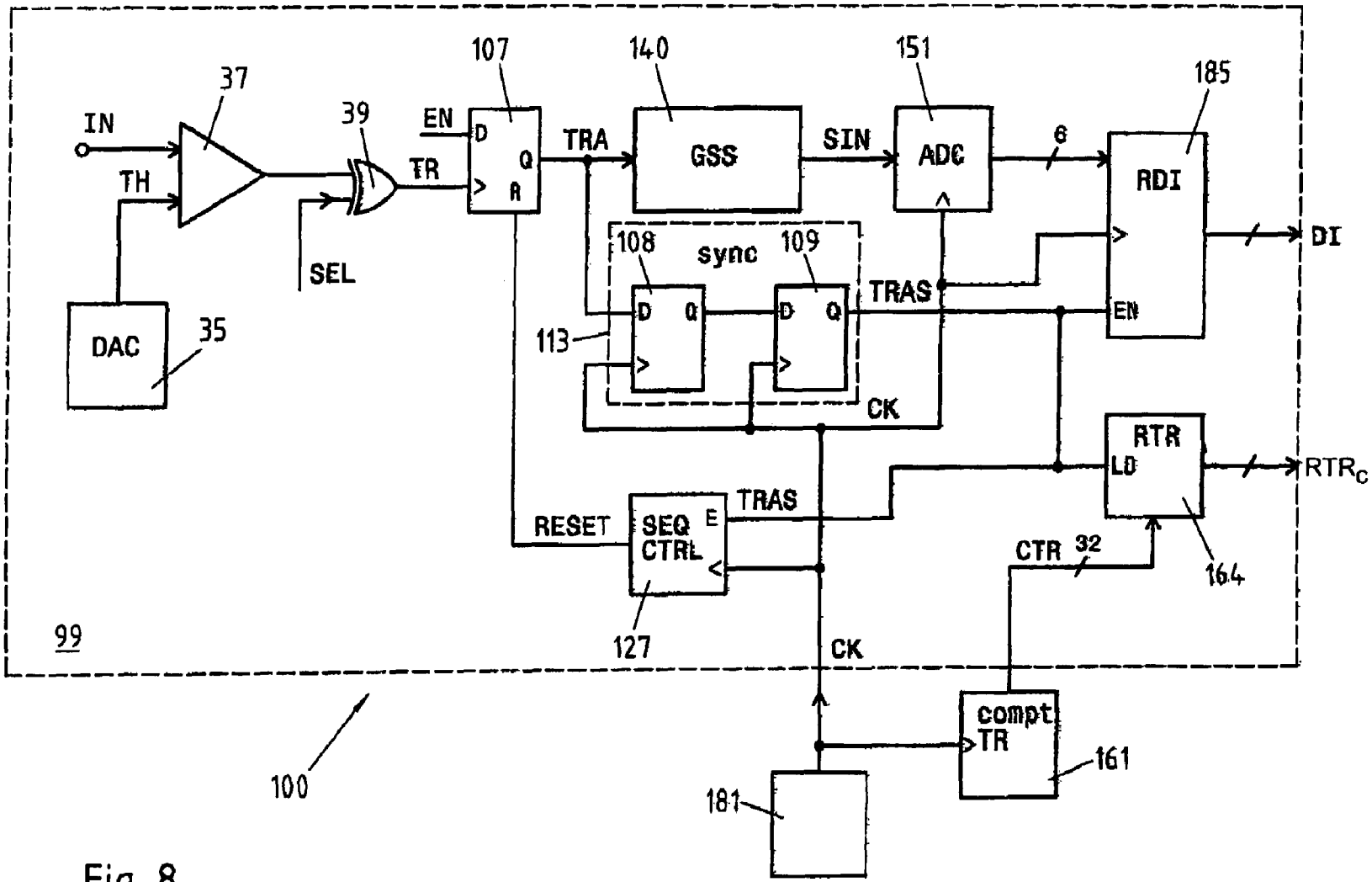
FIG. 8 represents another embodiment of a time converter according to the invention.

The generator 181 of the FIG. 8 produces a clock signal at constant rate CK, autonomously or synchronously with an external clock signal 82. The time base circuit 181 can comprise a PLL and its output frequency will be chosen so as to be adapted to the used ADC and to the speed of the system's various digital circuits, implemented in a FPGA. The characteristics required for the time base are:

- a great accuracy at long term, in ppm, which determines the precision of the TDC on its measuring range and depends on the quality of the reference frequency of the PLL;
- a very low phase noise (measured in picoseconds rms) on the measurement duration.

The real time counter 161 of the time converter 100 counts the number of pulses CK from the beginning to the end of the measurement. Its depth, in bits, determines the range of the TDC, i.e. the maximal duration between the first and the last event recorded by the TDC module. The value of the counter 161 is available on the CTR bus. Typically, a depth of 32 bits for a clock rate CK of 1 GHz and a depth of 4.3 seconds will be chosen, although other values are obviously also possible for these parameters.

The time converter 100 also comprises at least two acquisition channels 99. Several channels can share a single time base circuit 181 and a common counter 161 to constitute a multi-channel TDC capable of sampling several signals at a time, each signal being measured by one of the channels of the TDC.

The digital trigger signal TR is generated from the input signal by the comparator 37, the DAC 35 and the gate 39, as already explained. The signal TR is applied at the clock input of a sweep circuit D 107, allowing a trigger acceptation function to be implemented and giving rise, when the control signal ENA is in mode high, to an accepted trigger signal TRA.

The signal TRA, whose initial flank is synchronous with the event to be measured, triggers a synchronized sine generator (GSS) 140. The circuit 140 is build in similar fashion to the circuit 40 represented in FIG. 5, and comprises an oscillator LC controlled by a start/stop circuit. In the stop mode, a constant current is injected in the inductance L, ad the quality factor Q of the resonator is kept low by the low resistance of the diodes D1, D2 in their conduction state.

When TRA switches to high value, the injection of current and the biasing of the transistor are suddenly interrupted, the factor Q then becomes high and the resonator LC enters into weakly damped sinusoidal oscillation. The sinusoidal oscillation SIN is synchronous with TRA and extends over several periods, practically up to the instant when the signal TRA returns to the mode low. This circuit thus memorizes, by the value of its output phase, the arrival instant of the event that has generated the trigger.

In this example, the output of the GS 140 (SIN) is of the type single-ended, though the invention also extends to the case of a differential output.

Unlike the embodiments previously presented, the sinusoidal signal SIN is applied at the digitizing input of an ADC 151. The ADC 151 continuously samples the output of the generator 140, according to the rate imparted by the signal CK present at its clock input.

The circuit 113, composed by the cascade of flip-flops 108 and 109, generates the accepted trigger signal synchronized with the clock TRAS. This circuit comprises at least two D-type flip-flops and has for function to produce a signal whose transitions are synchronous to those of the CK, without metastable states. This signal will be used to freeze the state of the system's real time counter.

The samples measured by the ADC 151 are transmitted to a register of interpolated data (RDI) 185, having content represented by DI in FIG. 8. This digital memory for samples accepts data coming from the ADC 151 when the signal TRAS is in mode high, and records only the ADC's output data that are of interest for determining the arrival instant of the event, as will be explained further below.

The selection of events useful for determining the arrival time is effected thanks to the controller of sequence of acquisition 127. This circuit contains a counter for the samples to be accepted for determining the number of samples to be recorded at each event. When this number is reached, the signal RESET resets the sweep circuit 107. The signals TRA and TRAS thus return to mode low, the first immediately and the second after a number of clock cycles determined by the number of D-type flip-flops in the circuit 113.

The controller of sequence of acquisition 127 offers two operating modes that can be selected. In a first mode (multi-hit mode), it resets itself to be ready to accept a new event immediately after a recorded event. In a second operating mode (single-hit mode), it keeps the RESET signal high, thus preventing the acquisition of new events until it receives a new re-initialization command.

The real time register RTR 164 memorizes the state of the bus CTR at the moment of the positive transition of the TRAS. The value recorded in the register 164, represented by $RTR_C$ in FIG. 8, constitutes a coarse measurement of the instant of the trigger TR.

Figure 9:
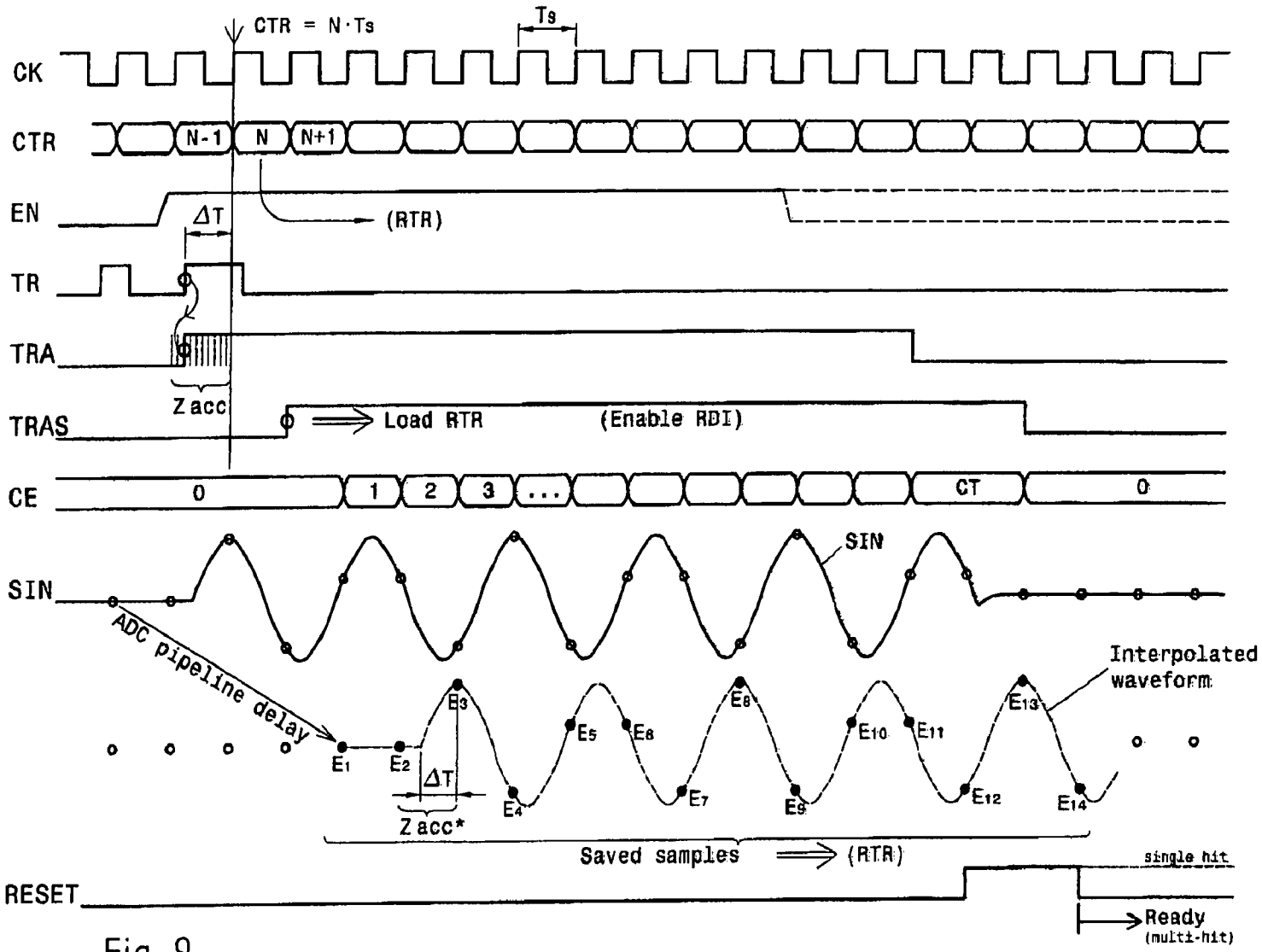
FIG. 9 represents a chronogram illustrating the functioning of the circuit of FIG. 8.

With reference now to the chronogram of FIG. 9, it can be seen that the temporal zone of acceptation of a trigger TRA is determined from the coarse measurement and the known delay introduced by the synchronization circuit, inside the uncertainty range $Z_{acc}$, corresponding to a period of the clock CK. The chronogram 9 is valid for a synchronization with two flip-flops; the same reasoning can however also apply to a different synchronization circuit.

The interpolation of the data acquired by the ADC supplies, as in the first embodiment of the invention, the exact time ΔT of the TRA's transition inside the window $Z_{acc}$.

The samples stored in the register RDI 185 following each trigger pulse are thus given, in the approximation of negligible damping, Q=∞.

$$E_K=A\cdot\sin(\omega_0(k\cdot T_S+\Delta T))+D \quad (3)$$

In this expression, the system of equations (2) can be recognized. The system (3) is thus determined if the number N of samples is equal to 4 and over-determined if N>4. In the latter case, it will be possible to use additional information to increase the accuracy of the measurement of ΔT, as in the preceding examples.

In the case where the resonator LC has a factor Q that is real (Q≠∞), the sinusoid generated by the circuit 140 has the shape:

$$\mathrm{SIN}=A\cdot\exp(-t/\tau)\cdot\sin(\omega_0 t+\phi_0)+D$$

The unknown quantities to be determined number 5 (A, $\tau_0$, $\omega_0$, $\phi_0$, D) and the algorithm used will be a fit with 5 parameters, allowing ΔT to be determined as soon as N, the number of samples, is greater than or equal to 5.

The end of the interval $Z_{acc}$ coincides with the real time stored in the register RTR 162, so the instant of arrival of an event can be obtained by:

$$t_{ev}=N\cdot T_S-\Delta T \quad (4)$$

where $T_S$ is the period of the clock signal CK.

The position and the size of the pulse TRAS, corresponding to the acquisition window of the register RDI 162, will be chosen to store a sufficient number of samples $E_i$, also taking into account the delay introduced by the ADC 151 (pipeline delay) as indicated in FIG. 9.

In this example, the elements 107, 113, and 127 essentially have the function of generating the delay signal TRAS to select the events that are really useful for determining the trigger instant of the trigger TR. This selection could however also be performed or completed in a subsequent step, for example by a software element, residing in the control unit of the converter 100, or in an external computer. CE represents a value of a sample counter register comprised in sequence controller 127.

Possibly, one will be able to select only a subset of the samples $E_i$, for example to avoid using the first sample of the sinusoid ($E_3$ in FIG. 9) if one suspects that the oscillator GSS 140 has a transitory starting phenomenon.

The circuits proposed could also function with other wave shapes, different from the sinusoidal shape. Any wave shape that is repetitive and synchronous with a trigger could in principle be used. For example, one could replace the generators 51, 52 and 151 by saw-toothed signal or triangular signal generators.

It has been seen that the time converter of the present invention can advantageously be integrated in a multi-channel device, comprising several channels 99 in a module that can be interfaced with a communication bus. In the case of a multi-channel device, the different channels of a module can be sequenced to achieve a dead time close to zero in mono-channel mode.

The TDC according to the invention can be realized in the shape of a module element, provided with a connector allowing it to be connected to a data bus, such as for example a PCI, VXI or VME bus. In this case, each module constitutes a card having a connector on one side, so that it can be plugged in removable fashion and electrically connected with a motherboard.

The invention has been described hereinabove using specific examples and embodiments; however, it will be understood by those skilled in the art that various alternatives may be used and equivalents may be substituted for elements and/or steps described herein, without deviating from the scope of the invention. Modifications may be necessary to adapt the invention to a particular situation or to particular needs without departing from the scope of the invention. It is intended that the invention not be limited to the particular implementations and embodiments described herein, but that the claims be given their broadest interpretation to cover all embodiments, literal or equivalent, disclosed or not, covered thereby.

What is claimed is:

1. A device for measuring the temporal position of an event, comprising:

a signal generator for generating a periodical signal synchronous with the event; and an analog-to-digital converter for measuring a plurality of samples of a reference signal during said event, wherein the values of said samples determines a phase of said reference signal, said phase being correlated to the temporal position of the event.

2. The device according to claim 1, wherein said periodical signal determines the rate of acquisition of said analog-to-digital converter and said first reference signal is a continuous periodical signal.

3. The device according to claim 2, further comprising a second analog-to-digital converter for measuring an amplitude of a second reference signal having a predetermined phase difference relative to said first reference signal, during said event.

4. The device according to claim 2, further comprising a coarse measuring device including a first register and a second register for counting the number of periods of said first and/or second reference signal, and including computing means for determining said coarse measurement from the value of one of said first register and said second register, the register used being chosen to avoid errors induced by the transitions of said number of periods.

5. The device according to claim 2, further comprising a coarse measuring device including a first register and a second register for counting the number of periods of said first and/or second reference signal, and including computing means for determining said coarse measurement from the value of one of said first register and second register, the register used being the one whose reference signal is furthest away from a transition.

6. The device according to claim 2, wherein said reference signal or signals are sinusoidal signals in quadrature.

7. The device according to claim 6, wherein said sinusoidal reference signal or signals are generated by filtering rectangular signals.

8. The device according to claim 1, wherein said reference signal is said synchronous periodical signal and the sampling rate of said ADC is determined by a stable clock.

9. The device according to claim 8, further comprising computing means for deducing the value of said phase of said periodical signal and/or the temporal position of said event from said plurality of measured samples.

10. The device according to claim 8, further comprising interface means for transferring the plurality of measured samples.

11. The device according to claim 8, wherein said startable signal generator includes at least one oscillator LC.

12. The device according to claim 8, further comprising a delay circuit for selecting the samples useful for determining the time of said event.

13. The device according to claim 1, further comprising means for calibrating the phase of said reference signal or signals.

14. The device according to claim 1, comprising means for changing the frequency of said reference signal or signals.

15. The device according to claim 1, wherein said event is constituted by a change of mode of a trigger signal, said trigger signal being generated by a comparator comparing an acquisition signal with a threshold value.

16. The device according to claim 15, wherein said comparator is a constant factor discriminator.

17. The device according to claim 15, further comprising a digital-to-analog converter for generating said threshold value.

18. A system comprising a device according to claim 1, allowing the temporal position of different events to be measured, said system further comprising a memory in which the measurement results of said device are written, said memory being accessible by a digital processing system.

19. The system according to claim 18, mounted on an interconnection card comprising a connector on one side, so that it can be plugged in a removable fashion and electrically connected with a motherboard.

20. The system according to claim 18, further comprising one or more additional of said devices, wherein the measurement results of said one or more additional devices are written in said memory or in one or more additional memories, said memories being accessible by a digital processing system.

21. The device of claim 1, further comprising a discriminator circuit for generating a trigger signal in response to the event, wherein said signal generator generates said periodical signal in response to said trigger signal.

22. The device of claim 21, wherein said discriminator circuit includes a discriminator and a logic gate.

23. A device for measuring the temporal position of an event, comprising:

a startable signal generator for generating a periodical signal synchronous with said event and whose phase is correlated to the temporal position of said event, wherein said measuring device includes a first analog-to-digital converter for measuring a plurality of samples of a first reference signal during said event, the values of said samples determining said phase of said periodical signal.

* * * * *